US006568786B2

(12) United States Patent
Sarmast et al.

(10) Patent No.: US 6,568,786 B2
(45) **Date of Patent: *May 27, 2003**

(54) METHOD AND APPARATUS FOR INK-JET DROP TRAJECTORY AND ALIGNMENT ERROR DETECTION AND CORRECTION

(75) Inventors: Sam Michael Sarmast, Vancouver, WA (US); Steven B Elgee, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/142,383

(22) Filed: May 8, 2002

(65) Prior Publication Data

US 2002/0126173 A1 Sep. 12, 2002

Related U.S. Application Data

(63) Continuation of application No. 09/954,761, filed on Sep. 14, 2001, now Pat. No. 6,450,608, which is a continuation of application No. 09/470,928, filed on Dec. 22, 1999, now Pat. No. 6,315,383.

(51) Int. Cl.[7] ..... B41J 29/393
(52) U.S. Cl. ..... 347/19
(58) Field of Search ..... 347/19, 81

(56) References Cited

U.S. PATENT DOCUMENTS

| | | | | | |
|---|---|---|---|---|---|
| 3,836,912 | A | * | 9/1974 | Ghougasian et al. | 347/81 |
| 4,323,905 | A | | 4/1982 | Reitberger et al. | 347/6 |
| 4,328,504 | A | | 5/1982 | Weber et al. | 347/14 |
| 4,333,083 | A | * | 6/1982 | Aldridge | 347/81 |
| 4,540,990 | A | * | 9/1985 | Crean | 347/78 |
| 4,551,731 | A | * | 11/1985 | Lewis et al. | 347/78 |
| 4,794,411 | A | | 12/1988 | Taub et al. | 347/47 |
| 4,922,268 | A | | 5/1990 | Osborne | 347/19 |
| 4,922,270 | A | | 5/1990 | Cobbs et al. | 347/19 |
| 5,036,340 | A | | 7/1991 | Osborne | 347/19 |
| 5,109,239 | A | | 4/1992 | Cobbs et al. | 347/19 |
| 5,125,275 | A | | 6/1992 | Wilda et al. | 73/756 |
| 5,160,938 | A | * | 11/1992 | Fargo et al. | 347/19 |
| 5,289,208 | A | | 2/1994 | Haselby | 347/19 |
| 5,376,958 | A | | 12/1994 | Richtsmeier et al. | 347/104 |
| 5,402,164 | A | * | 3/1995 | Mutoh | 347/81 |
| 5,404,020 | A | | 4/1995 | Cobbs | 250/548 |
| 5,448,269 | A | | 9/1995 | Beauchamp et al. | 347/19 |
| 5,477,244 | A | * | 12/1995 | Shibata et al. | 347/19 |
| 5,583,546 | A | * | 12/1996 | Balousek | 347/19 |
| 5,831,658 | A | | 11/1998 | Iga et al. | 347/171 |
| 5,835,108 | A | | 11/1998 | Beauchamp et al. | 347/19 |
| 5,864,063 | A | * | 1/1999 | Otani et al. | 73/514.32 |
| 6,062,668 | A | | 5/2000 | Cruz-Uribe | 347/19 |
| 6,145,959 | A | * | 11/2000 | Lund et al. | 347/40 |
| 6,315,383 | B1 | * | 11/2001 | Sarmast et al. | 347/19 |

FOREIGN PATENT DOCUMENTS

| | | | | |
|---|---|---|---|---|
| EP | 0908315 | | 4/1999 | |
| JP | 4-235058 | * | 8/1992 | B41J/2/18 |
| WO | WO 99/30138 | * | 6/1999 | B60S/1/08 |

* cited by examiner

*Primary Examiner*—Hai Pham
*Assistant Examiner*—Blaise Mouttet

(57) ABSTRACT

A method and apparatus for ink-jet drop generator ink drop characteristics uses a drop detector target mounted in the printing zone of a hard copy apparatus. The detector target includes a matrix of individual elements sized approximately the same as pixel targets in printing operations. A detector target is mounted adjacently to the paper path of the apparatus such that test firing can be accomplished prior to each swath scan across the print media. By pre-firing nozzles to be used in the next swath at the detector target, actual trajectory errors and drop volumes can be analyzed in real-time. Alternate embodiments and methods are described.

3 Claims, 6 Drawing Sheets

METHOD AND APPARATUS FOR INK-JET DROP TRAJECTORY AND ALIGNMENT ERROR DETECTION AND CORRECTION

CROSS REFERENCE TO RELATED APPLICATION(S)

This is a continuation of application Ser. No. 09/954,761 filed on Sep 14, 2001, now U.S. Pat. No. 6,450,609, which is a continuation of Ser. No. 09/470,928, filed Dec. 22, 1999, now U.S. Pat. No. 6,315,383.

BACKGROUND OF THE INVENTION

1. Field of the Invention

The present invention relates generally to ink-jet hard copy apparatus, and, more specifically, to methods and apparatus for the use of electrostatic devices for detection of ink drop characteristics and printing with correction for offsets.

2. Description of Related Art

The art of ink-jet technology is relatively well developed. Commercial products such as computer printers, graphics plotters, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [sic] *Devices,* chapter 13 (Ed. R. C. Durbeck and S. Sherr, Academic Press, San Diego, 1988).

FIG. 1 depicts an ink-jet hard copy apparatus, in this exemplary embodiment a computer peripheral printer, 101. A housing 103 encloses the electrical and mechanical operating mechanisms of the printer 101. Operation is administrated by an electronic controller 102 (usually a microprocessor-controlled printed circuit board) connected by appropriate cabling to a computer (not shown). Cut-sheet print media 105, loaded by the end-user onto an input tray 107, is fed by a suitable paper-path transport mechanism (not shown) to an internal printing station where graphical images or alphanumeric text is created. A carriage 109, mounted on a slider 111, scans the print medium. An encoder 113, 114 subsystem is provided for keeping track of the position of the carriage 109 at any given time. A set of ink-jet pens, or print cartridges, $\mathbf{115}_x$ (where the letter is a color designation, e.g., cyan (C), magenta(M), yellow (Y), black (K), red (R), blue (B), green (G), or a fixer chemical (F)) are releasably mounted in the carriage 109 for easy access. In pen-type hard copy apparatus, separate, replaceable or refillable, ink reservoirs $\mathbf{117}_x$ are located within the housing 103 and appropriately coupled to the pen set 115 via ink conduits 119. Once a printed page is completed, the print medium is ejected onto an output tray 121. Printing is accomplished on the print medium as it transits a print zone 123.

A simplistic schematic of a swath-scanning ink-jet pen 200 is shown in FIG. 2 (PRIOR ART). The body 210 of the pen 200 generally contains an ink accumulator and regulator mechanism 212. The internal accumulator and regulator are fluidically coupled 119 (FIG. 1 only) to an off-axis ink reservoir $\mathbf{117}_x$ in any known manner to the state of the art. The printhead 214 element includes an appropriate electrical connections 220 (such as a tape automated bonding flex tape) for transmitting signals to and from the printhead. Columns of individual nozzles 217 form an addressable firing array 216. The typical state of the art scanning pen printhead may have two or more columns with more than one-hundred nozzles per column, each nozzle having a diameter of about 1/300th inch or less. Multi-color pens having the nozzle array 216 is subdivided into discrete subsets, known as "primitives" are also known in the art. In a thermal ink-jet pen, the drop generator includes a heater resistor subjacent each nozzle which on command superheats local ink to a cavitation point such that an ink bubble's expansion and collapse ejects a droplet from the associated nozzle 217. In commercially available products, piezoelectric and wave generating element techniques are also used to fire the ink drops. Degradation or complete failure of the drop generator elements cause drop volume variation, trajectory error, or misprints, referred to generically as "artifacts," and thus affect print quality.

In essence, the ink-jet printing process involves digitized dot-matrix manipulation of drops of ink, or other liquid colorant, ejected from a pen onto an adjacent print media. [For convenience of describing the ink-jet technology and the present invention hereinafter, all types of print media are referred to simply as "paper," all compositions of colorants are referred to simply as "ink," and all types of hard copy apparatus are referred to simply as a "printer." No limitation on the scope of invention is intended nor should any be implied.] Each column or selected subset of nozzles selectively fires ink droplets (typically each being only a few picoliters in liquid volume, having a nominal diameter of only about ten in flight and forming a dot of approximately forty $\mu$m on the paper) that create a predetermined print matrix of dots on the adjacently positioned paper as the pen is scanned. The pen scanning axis is the x-axis, the paper path is the y-axis and the ink drop firing direction is the z-axis; related linear offsets are referred to as delta-x, delta-y and delta-z, respectively, and rotational offsets are referred to as theta-x (printhead planar pitch), theta-y (roll) and theta-z (yaw). A given nozzle of the printhead is used to address a given matrix column print position on the paper (referred to as a picture element, or "pixel"). Horizontal positions, matrix pixel rows, on the paper are addressed by repeatedly firing a given nozzle at matrix row print positions as the pen is scanned. Thus, a single sweep scan of the pen across the paper can print a swath of tens of thousands of dots. The paper is stepped to permit a series of contiguous swaths. Complex digital dot matrix manipulation is used to render alphanumeric characters, graphical images, and even photographic reproductions from the ink drops. Page-wide ink-jet printheads are also contemplated and are adaptable to the present invention.

As can now be recognized, the seemingly simple process of creating a computer print by scanning a plurality of printheads while actively firing minute ink droplets across a z-axis gap onto a sheet of paper as a digital dot matrix of organized pixels in order to form sophisticated graphics and photographs is actually a highly complex process. The reduction of visible artifacts in the print is a constant concern of the system designer.

A variety of techniques have been used over the years since the inception of ink-jet printing to ensure appropriate dot placement. In U.S. Pat. No. 4,794,411, filed in 1987 by Taub et al., a THERMAL INK-JET HEAD STRUCTURE WITH ORIFICE OFFSET FROM RESISTOR methodology teaches a controlling of misdirection of fired drops by proper nozzle design. In U.S. Pat. No. 4,922,268, filed in 1989 by Osborne, a PIEZOELECTRIC DETECTOR FOR DROP POSITION DETERMINATION IN MULTI-PEN THER- MAL INK JET PEN PRINTING SYSTEMS teaches a methodology for mapping the positions of nozzles with respect to a pattern of openings in the detector [U.S. Pat. No. 5,036,340 filed in 1990 by Osborne is a continuation-in-part of '268.] In U.S. Pat. No. 4,922,270 filed simultaneously with Osborne by Cobbs et al., an optical or piezoelectric or electrostatic phase plate detector through which a drop is fired and measurements are used for INTER PEN OFFSET DETERMINATION AND COMPENSATION IN MULTI-PEN THERMAL INK JET PEN PRINTING SYSTEMS [U.S. Pat. No. 5,109,239 is a continuation-in-part of '270]. In U.S. Pat. No. 5,404,020, filed in 1993 Cobbs teaches a PHASE PLATE DESIGN FOR ALIGNING MULTIPLE INKJET CARTRIDGES BY SCANNING A REFERENCE PATTERN. In U.S. Pat. No. 5,448,269, filed in 1993 by Beauchamp et al., MULTIPLE INKJET CARTRIDGE ALIGNMENT FOR BIDIRECTIONAL PRINTING BY SCANNING A REFERENCE PATTERN is shown. In U.S. Pat. No. 5,835,108, filed in 1996, Beauchamp et al. teach a CALIBRATION TECHNIQUE FOR MISDIRECTED INK-JET PRINTHEAD NOZZLES. Each of the aforementioned patents is assigned to the common assignee herein and incorporated herein by reference.

As thermal ink-jet pens are used, damage may occur, such as due to a printhead crash against the adjacent paper, resistor burn-out, ink cogation, and the like as is known to those skilled in the art, causing drop characteristic changes and trajectory changes. Ink drop trajectory can change as a print is being rendered due to ink puddling around the nozzle orifice. Frequent servicing of the printhead, such as by spitting into a waste ink collector or wiping at a service station, degrades throughput. Moreover such wiping of the printhead can wear the nozzle plate which can cause trajectory errors. Thus, while pen "health" is a constant concern, optimally, a pen should only be serviced if and when it is required.

Other techniques related to the actual pixel printing, such as error diffusion, resolution synthesis, or other printing mode digital manipulation are also employed to reduce the number or visibility of print artifacts.

No technique appears to be available for exact printing plane ink drop trajectory determination during printing. Therefore, a method and apparatus is needed to verify each nozzle operation during a print job without impacting the speed of the print job. The method and apparatus should characterize the entire pen swath height in one or two passes.

SUMMARY OF THE INVENTION

In a basic aspect, the present invention provides a method for detecting scanning ink-jet printhead drop firing characteristics, including the steps of: determining a set of drop generators of the printhead to be used in a next printing scan from a predetermined set of data; firing selected drop generators at a detector fixedly located within a printing zone of the printhead, the detector having a matrix of detecting elements sized substantially identically to pixels to be printed wherein the elements are arranged in a like plane and in like orientation as the pixels to be printed; and determining ink drop firing characteristics as a function of a correlation of the set of data to a second set of data produced by the detecting elements receiving drops of ink from the selected drop generators.

In another basic aspect, the present invention provides a method of printing with a set of scanning ink-jet printheads, including the steps of: receiving a first set of data indicative of a printed image to be rendered; parsing the data into swaths subsets; determining printhead nozzle firing requirements for a next swath to be printed; prior to printing the next swath on a sheet of print media, firing nozzles determined as required for the next swath at a drop detection target located within a print zone of the printheads and having a matrix of detecting elements sized as a function of size of pixels to be printed wherein the elements are arranged in a like plane and in like orientation as the pixels to be printed and located adjacently to the sheet of print media in the print zone; based upon detecting elements struck by drops from fired nozzles, determining if any of the fired nozzles is malfunctioning and based upon detecting elements struck by drops from fired nozzles, determining if any of the fired nozzles has a firing trajectory error; and correcting for any detected malfunctioning nozzles and any firing trajectory errors prior to printing the next swath.

In another basic aspect, the present invention provides an ink-jet hard copy apparatus, having a printing zone and mechanisms for transporting print media to and through the printing zone, including: at least one scanning printhead mechanism for scanning across the printing zone, including scanning across the print media width and an additional predetermined region of the printing zone adjacent to the print media transported thereto, each printhead mechanism having a plurality of individually selectable ink drop generators; an ink drop detection target mechanisms for receiving individual ink drops fired from individually selected ink drop generators, the target mechanisms being mounted in the printing zone in the additional predetermined region; associated with the target mechanisms, mechanisms for determining individual drop detector malfunctions and firing trajectory errors; and associated with the mechanisms for determining individual drop detector malfunctions and firing trajectory errors, mechanisms for providing signals indicative of the individual drop detector malfunctions and firing trajectory errors.

In another basic aspect, the present invention provides a method for detecting and correcting ink drop firing misalignments including the steps of: placing an ink drop detector in a printing zone plane of an ink-jet apparatus; firing ink drops from known position and known timing using a predetermined firing pattern at a predetermined pattern of detector mechanisms for providing signals indicative of position and timing of dots formed by the ink drops on the detector mechanisms; comparing the signals to the known position and known timing; and deriving ink drop firing correction signals based on the step of comparing.

Some of the advantage of the present invention are:

it provides a real time method and apparatus for characterizing ink drop trajectories and alignments of an ink-jet printhead;

it provides an apparatus scalable to a plurality of printheads and a variety of print zone designs;

it provides an apparatus for detecting inter-pen and intra-pen offsets;

it additionally provides a drop volume characterization technique;

in a first embodiment, the detector device can be produced by current microcircuit fabrication technology;

in the first embodiment, signal processing circuits can be incorporated into the silicon die used for a drop detector;

in the first embodiment, detector devices can be scaled for specific implementations using known manner integrated circuit fabrication technology; and in a second embodiment, detector devices are fabricated using simple, cost-efficient, printed circuit technology.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PRESENT INVENTION

Reference is made now in detail to a specific embodiment of the present invention, which illustrates the best mode presently contemplated by the inventors for practicing the invention. Alternative embodiments are also briefly described as applicable.

It should be noted from the outset that generally even low cost state-of-the-art ink-jet printers have at least two pens, one firing true black ink and the other containing three color inks using a printhead segregated into primitives for each color. Higher print quality and higher throughput printers use at least one separate printhead for each color ink. For example, the use of a plurality of STAGGERED PENS IN COLOR THERMAL INK-JET PRINTER[S] is generally discussed in U.S. Pat. No. 5,376,958 by Richtsmeier et al. (assigned to the common assignee herein and incorporated herein by reference). One can readily perceive that therefore each pen not only needs to be axially aligned to the print media target plane to ensure accurate dot placement, but also there is a need to ensure that all pens fire appropriately with respect to each other, namely without a theta-z error. Thus, the present invention is directed to detecting a variety of both inter-pen and intra-pen error conditions.

Figure 1:
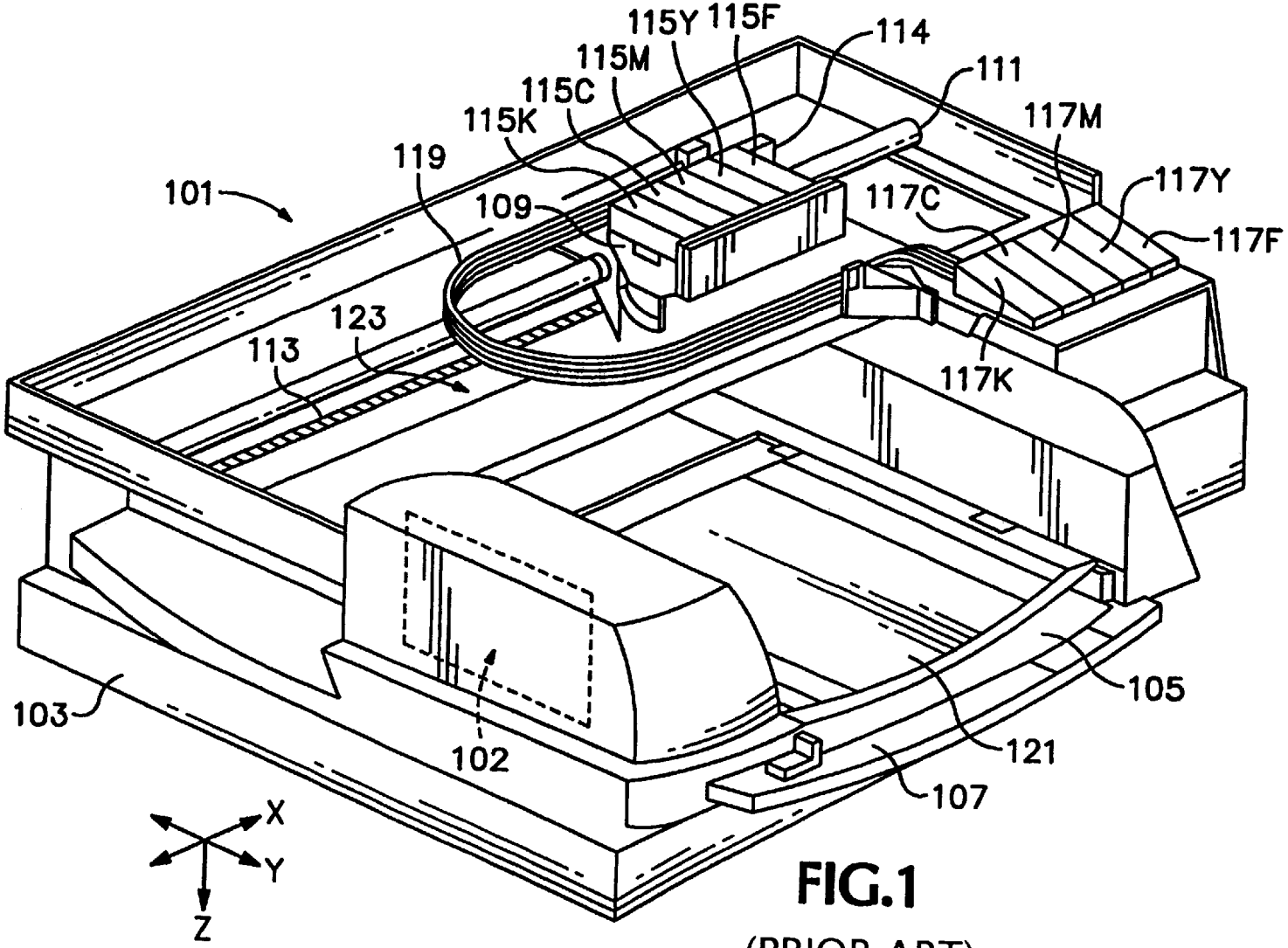
FIG.1 (PRIOR ART)
FIG. 1 (Prior Art) is a perspective drawing of an ink-jet hard copy apparatus.
Figure 2:
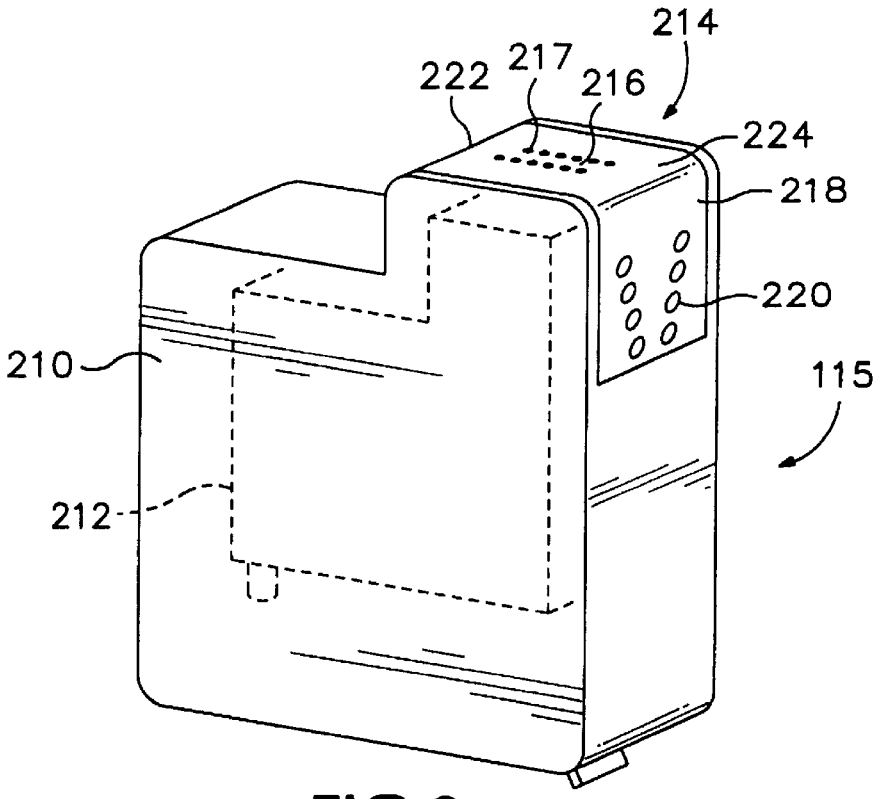
FIG.2 (PRIOR ART)
FIGS. 2 and 2A (both Prior Art) are schematic illustrations of an ink-jet writing instrument.
Figure 2A:
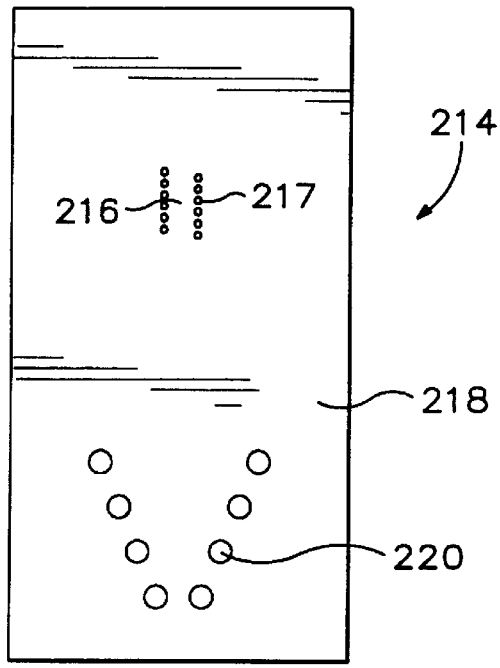
FIG.2A (PRIOR ART)
Figure 4A:
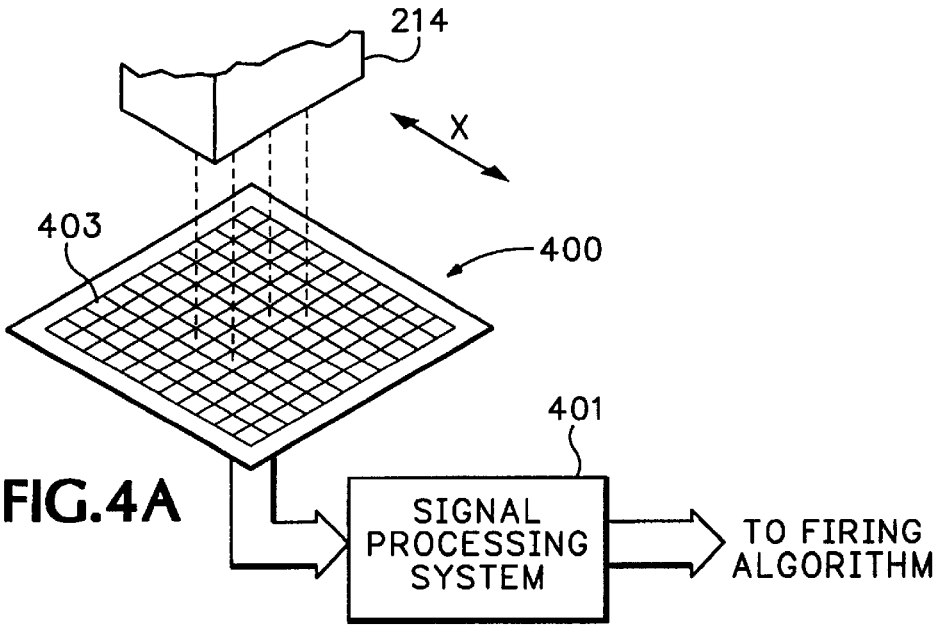
FIGS. 4 and 4A are schematic illustrations of a system in accordance with the present invention.
Figure 4B:
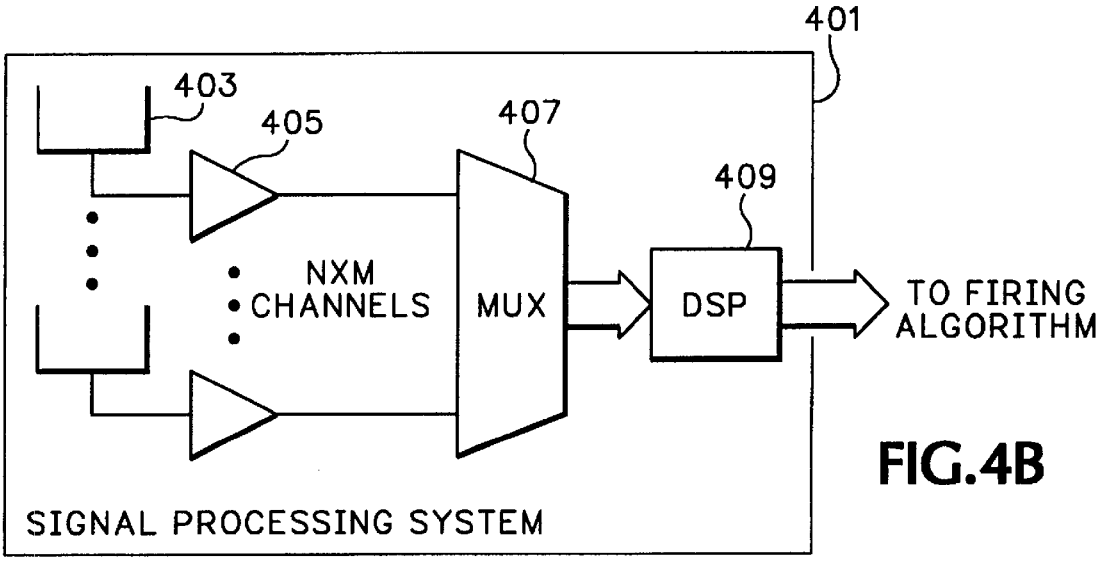

FIGS. 4A and 4B are schematic illustrations of an ink-jet drop detector system in accordance with the present invention. An electrostatic drop detector array ("EDD" or merely "detector" hereinafter) 400 is mounted in the print zone 123 (FIG. 1 only) at a location such that the carriage 109 traverses the EDD as it oscillates in the x-axis. The EDD array 400 is an ink drop target that comprises an N-by-M matrix of individual electrostatic detector elements 403 of a predetermined dimension, e.g., 5 microns by 5 microns, which can be formed in silicon to great precision, with the array having as many rows "N" and columns "M" as fits a particular pen and carriage configuration, as long as N and M are less than a typical drop diameter. In the state of the art, geometries which can be achieved in silicon are substantially smaller than drop geometries. Therefore, exotic arrays which can measure drop location in a small fraction of a drop diameter can be implemented, providing target locations that are, for example, measured in tenths of a ink drop-pixel dot size.

When a drop is ejected from the printhead it bears a charge as there is a relatively high electric field between the printhead and the detector which causes an accumulation of electrical charge in the ink drops. Details of this phenomenon are further discussed in the Schantz application, supra, but are not necessary to an understanding of the present invention. When the ink drop lands on a detector element 403, a charge transfer to that element occurs as the droplet discharges. The discharge is converted to an electrical current which is sensed. One type of detector signal processing that also can be employed in conjunction with the present invention is shown in published European Pat. App. EP 0908315 A2 by Schantz & Sorenson for INK DROP DETECTION, showing analog sensing elements tuned to ink drop bursts using pre-existing digital signal processing techniques can be employed (assigned to the common assignee herein and incorporated herein by reference).

For purposes of explaining the present invention, a simplified signal processing system 401 is shown in FIG. 4B. Letting each detector element 403 represent an intended target pixel, each channel signal of the N×M array is amplified 405 and multiplexed 407 such that changes in the array are sensed and the changed locations processed such that the apparatus' drop generator firing algorithm can be modified.

Thus, as the carriage 109 of pens $\mathbf{115}_x$ scans the EDD array 400, particular nozzles of interest—ordinarily the nozzles to be fired during the next carriage sweep across the paper—e.g., certain yellow ink nozzles and certain cyan ink nozzles that are designated for certain target pixels predetermined by the application program which has processed the data for rendering a color graphic swath—can first be fired at the EDD array designating predetermined target elements 403. The encoder subsystem 113, 114 (FIG. 1) provides the relative location the drops were fired from. The expected target elements 403 to be hit are known from the relative location of the target mounted in the printing zone 123 (also FIG. 1 only) to the instantaneous carriage location as given by the encoder subsystem 113, 114. Once the drops land on actual targets, any mis-location from the expected target elements 403 is detected. The firing algorithm can then be programmed to compensate, e.g., moving the timing of firing of a now determined trajectory error such that the proper image pixel is hit.

Conceivably ink droplets can be deposited on paper and, assuming the paper is in direct contact with a platen formed by the EDD detector, the paper will effectively act as dielectric—such as in a capacitor—and a discharge response would be detectable. It should be recognized that intimate contact between the paper and detector platen is essential.

Thus, such an alternative embodiment may want to employ a vacuum in order to ensure intimate contact.

Figure 3:
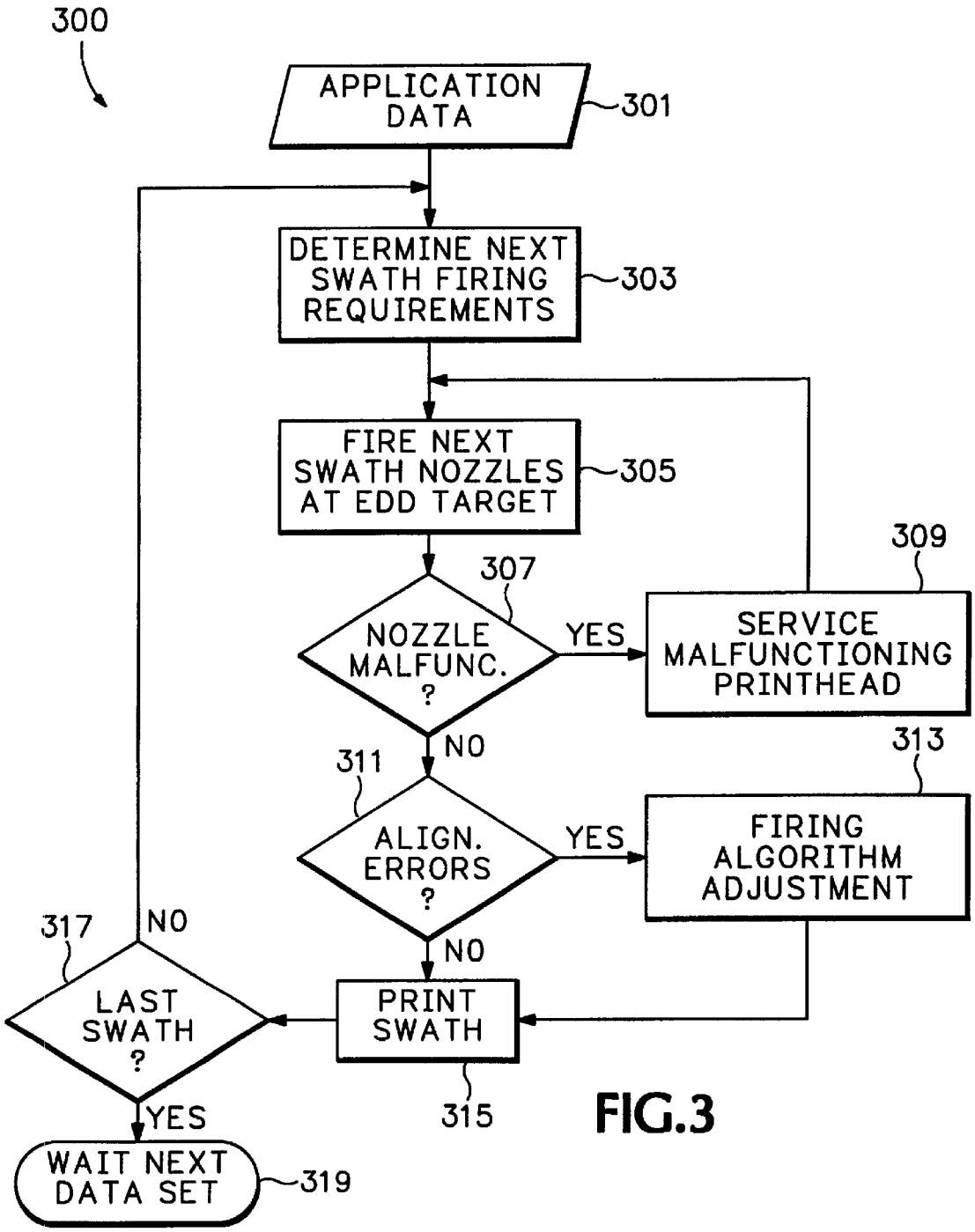
FIG. 3 is a flow chart of the methodology in accordance with the present invention.

FIG. 3 is an exemplary, macro-level, system operational process 300 in accordance with the present invention. It will be recognized by those skilled in the art that the processes in accordance with the present invention can be implemented as computerized code. From the end-user application program, e.g., HP™ PhotoSmart™ program, a data set 301 representative of an image is buffered for printing. The next swath nozzle firing requirements are determined from the data set, step 303. Using this acquired information, the carriage 109 (see also, FIGS. 1, 4 and 5) sweeps the EDD array 400 while firing the appropriately defined printhead 214, 216 nozzles 217, step 305. If a nozzle malfunction is detected, step 307, YES-path, a known manner printhead service routine can be performed, step 309, with another test firing, step 305. Note that two or more consecutive malfunctions may be used to trigger a warning to the end-user of a potential printer failure, e.g., requiring a pen $\mathbf{115}_x$ or ink reservoir $\mathbf{117}_x$ replacement. Assuming no major malfunction, step 307, NO-path, the drop placement data provided by EDD detector system 400, 401, 403 is determinative of nozzle alignment errors or offsets that can be expected during the next swath printing. If any such determinations are positively identified, step 311, YES-path, the information is routed to the printer's printhead firing algorithm and appropriate adjustments for changing particular nozzle use or timing made in accordance with the indicated offset needed to appropriately place a drop on the intended target pixel of the paper before printing the swath, step 315. If no nozzle alignment errors are detected from the firing at the EDD target pixels 403, step 311, NO-path, the swath is immediately printed. The operation cycles back, step 317, for the next swath and proceeds until the print job is completed, step 319.

Figure 6:
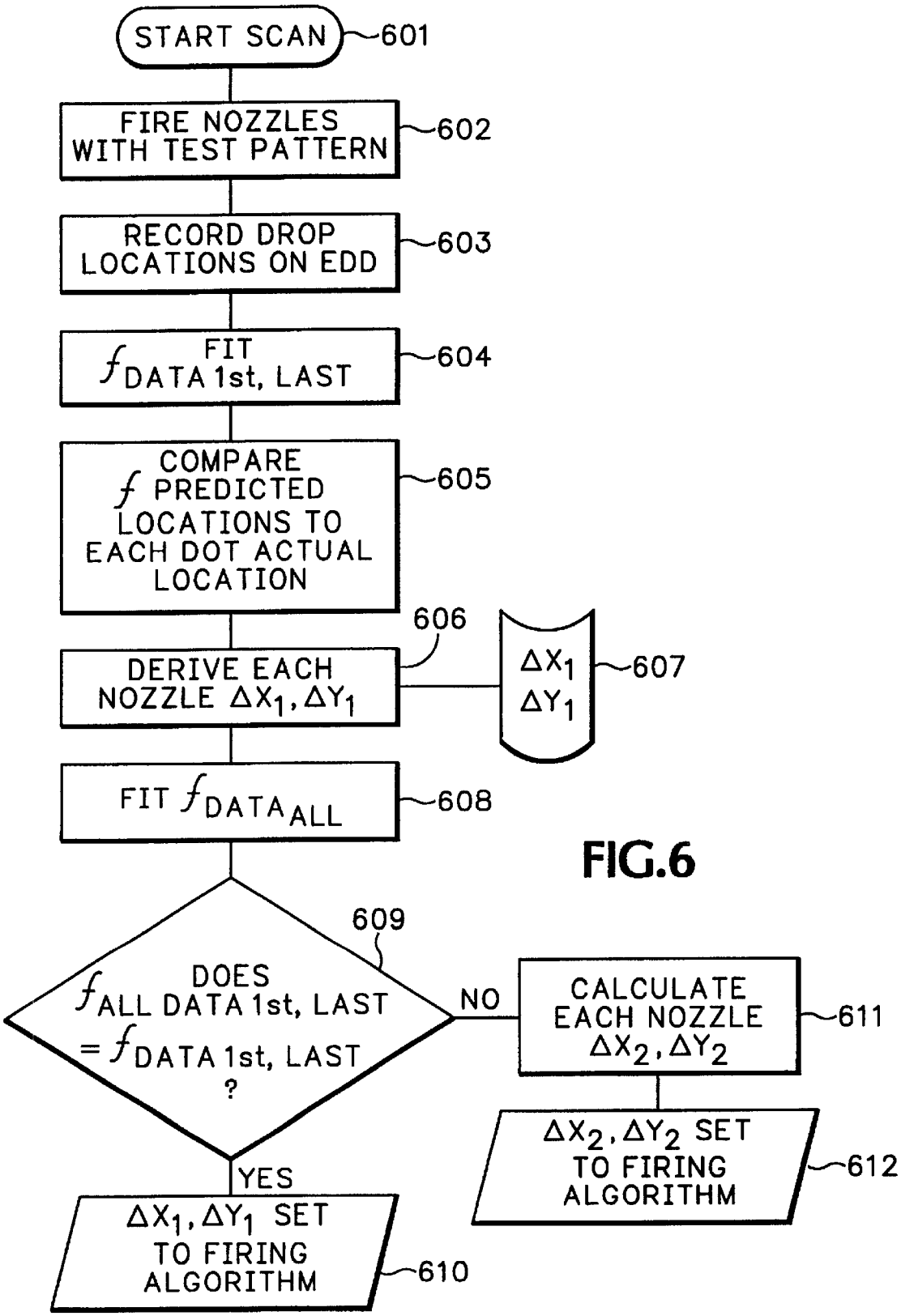
FIG. 6 is a flow chart outlining a data processing algorithm for error function derivation in accordance with the present invention.

The process of drop placement correction using the present detection system is shown in FIG. 6. While performing a test scan, step 601, all nozzles are fired at the array in a predetermined test pattern, step 602, e.g., firing one nozzle at a time, first using even-numbered nozzles of the printhead array, then the odd-numbered (or vice-versa). Using the actual detected position of the dots deposited by the first and last nozzle in each column as reference nozzles, step 603, an initial characterizing data function—such as a line-fit, curve-fit, or the like as would be known in the art—is derived, step 604, which then should predict the drop locations of each nozzle of the column, based on the assumption that the two reference nozzles are firing correctly. The detector reported location for each drop from the N×M printed array is compared to the predicted location of the derived characterizing data function, step 605. Any errors of reported location are used to derive an initial error term, $\Delta x_1$ and $\Delta y_1$, for each nozzle as needed, step 606. The initial error terms are stored 607.

A refined characterizing data function is then derived on all the nozzle actual dot placement data, step 608. Note that a variety of factors can be employed based on the knowledge of the specific printhead design. One solution is to derive a refined characterizing data function that fits the most number of nozzles. Another solution is to cluster nozzles of each column or printhead and derived a characterizing data that passes through the mean or median of the data.

The initial characterizing data function and refined characterizing data function are compared, step 609. If the refined characterizing data function has endpoints which match the reference nozzle dots (step 609, YES-path), the initial characterizing data is in fact accurate and the initial error terms can be employed in subsequent printing jobs, step 610. If, however, there is not a match (step 609, NO-path), one or both of the reference nozzle are not firing an expected ink drop trajectory. The comparison is analyzed to determine which reference nozzle has an error. The refined characterizing data function is then corrected to fix the reference nozzle error and to regenerate error terms, $\Delta x_2$ and $\Delta y_2$, for each nozzle, step 611. The refined error terms for each nozzle are sent to the printers firing algorithm, step 612.

Note that if the EDD array 400 is matched to the pen nozzle array, an entire pen can be characterized in one pass test firing. As printhead geometries change, the EDD array can be scaled correspondingly.

Note also that by placing a very large array or by placing multiple arrays in the printing zone, trajectory detection on multiple printheads can be processed in parallel.

Figure 5:
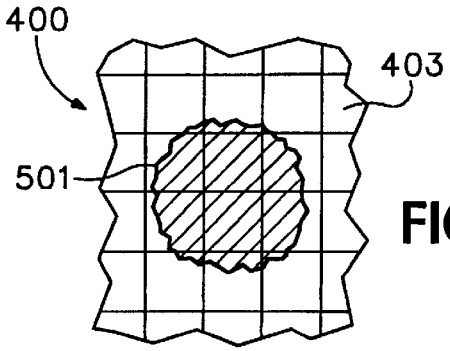
FIG. 5 is a detail schematic representation of the use of a detector in accordance with the present invention.

The same device can be employed to measure drop volume. As shown in FIG. 5, assuming a known relative thickness of a dot 501 formed by a drop of ink on the array 400, knowing the size of each EDD element 403 triggered by the drop, a estimated volume calculation algorithm can be employed. For example, if the thickness is a given constant and each target has a known area, the sum of a predetermined number of targets area less a factor for partially covered array elements 403 provides a drop volume estimate. Certain predetermined drop volume levels can be used in comparison to real-time measurements as indicators of potential problems, e.g., a partially clogged nozzle firing a very low drop volume. An EDD element 403 is substantially smaller than the diameter of a drop-dot. For example, with current state-of-the-art techniques with a pixel sized element 1 $\mu$m×1 $\mu$m, a typical drop of ink makes a substantially round dot that is about forty pixels in diameter. Simple geometric calculation of the area based on the number of elements impacted, where the outer elements are assumed to have about one-half coverage due to the curvature of the dot, times the assumed thickness (or empirically predetermined average thickness) provides the drop volume.

Another method for using the present invention to detect drop volume is to deposit drops of ink at the sensor plate 400 in a learning step. Assigning row and column designators (e.g., numbers for rows and letters for columns), the amount of ink coverage of the sensor pixels around the edge of a drop is characterized as either half-coverage or full-coverage with respect to signal strength. Using this characterization information, an algorithm that would properly weight the pixel responses at the edge of the drop of ink based on signal strength can be derived. For example, given the drop of ink as shown in FIG. 5, two center sensor cells are seen to have full-coverage; signal strength is rated at 100%. The surrounding cells have a signal strength that is less than 100%, so a scaling factor is applied, e.g. ½. Assuming uniform thickness of ink in the dot 501 and the columns covered are Ca, CB and Cc and the rows are R1, R2, R3 and R4, the derived algorithm can be expressed:

$$\text{Area}=Cb{:}R2+Cb{:}R3+[(Ca{:}R1+Cb{:}R1+Cc{:}R1)+(Ca{:}R2+Cc{:}R2)+(Ca{:}R3+Cc{:}R3)+(Ca{:}R4+Cb{:}R4+Cc{:}R4)]\div 2.$$

Then, $$\text{Volume}=\text{Area}*\text{Assumed thickness}.$$

An average of tested drops can be used as an average drop volume from a given nozzle. Generically, the algorithm is:

$$\text{Area}=\Sigma(A1*n1)+(k*\Sigma(A2*n2)$$

where,

A1=area of a fully covered array pixel,

A2=area of a partially cover array pixel, n1=number of pixels with 100% ink coverage, n2=number of pixels with less than 100% ink coverage, and k=a predetermined scaling factor.

Other methods for determining EDD element coverage—such as known manner counting algorithms or an A/D conversion on the output of each pixel transfer charge—can be used. The key is to have relatively small EDD target elements compared to the dot dimensions.

Figure 7:
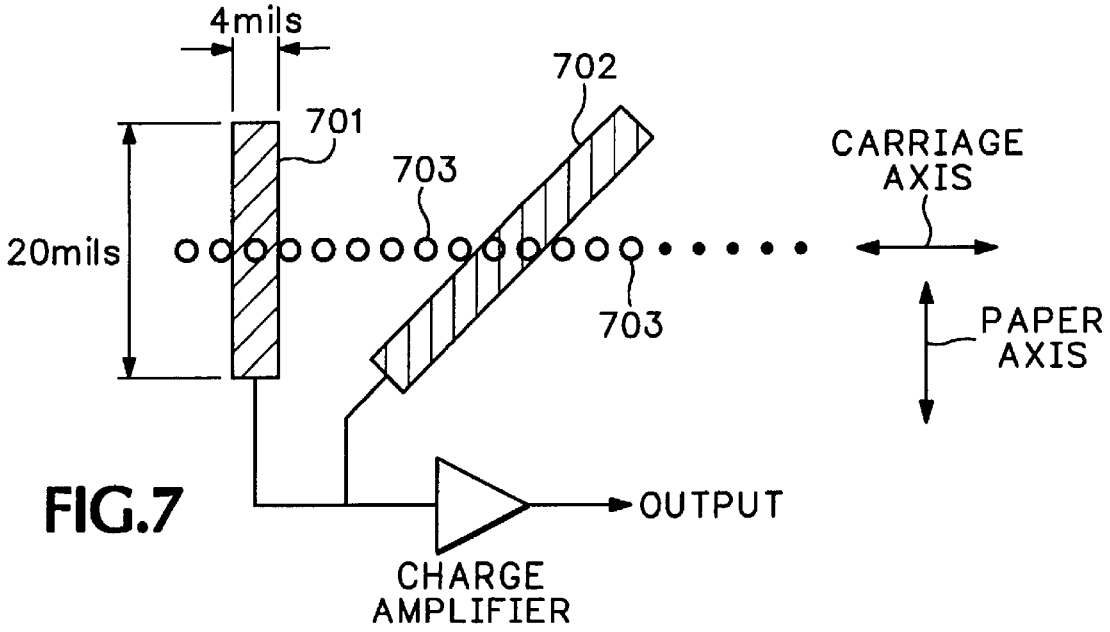
FIG. 7 is a schematic drawing of an alternative embodiment of the present invention.

Another embodiment is demonstrated schematically in FIG. 7. As fabrication of silicon microcircuit or thin-film process detectors is a relatively large manufacturing cost, a low cost solution is needed, particularly for implementations where the drop detection is to be incorporated as a full time feature on a printer, such as where printheads are end-user replaceable during the life of the printer and thus a recalibration is called for. Known manner printed circuit board processes are known to achieve a conductor line as small as four thousandths inch (0.004") and some commercial fabrication processors allege the ability to fabricate five micron ($5\times10^{-6}$ meter) line width resolution. By providing a detector board having conductor traces 701, 702 patterned at alternating 90-degree and 45-degree angles to the carriage scan, x-axis, misplacement in both the x-axis and y-axis can be detected. Each pair of traces 701, 702 is separated by more than a dot width.

Figure 8:
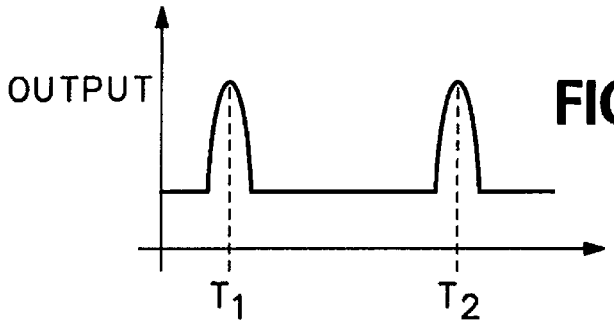
FIG. 8 is a waveform demonstrating data collection using the alternative embodiment of the present invention as shown in FIG. 7.

As the printhead is scanned at a constant speed, a continuous series of drops 703 is printed by a known nozzle using a given drop firing test pattern; time of firing and position is known from the encoder subsystem (see FIG. 1, supra), thus the drop intended target position for each firing can be predicted. The drops striking the target traces 701, 702 will discharge and provide an output signal. Looking also to FIG. 8, the signal at time T1 is due to the drops hitting trace 701. Compared to the predicted time/position, the actual time/position of T1 indicates drop position in the carriage scanning x-axis. Based on the scale of the operation, the median of time/position T1 provides a useful approximation for comparison.

The signal at T2 is due to the drops hitting trace 702. The difference between T2 and T1 in position indicates the drop direction in the paper axis. Drops fired too high in the y-axis are deposited late compared to the predicted T2–T1 time/position; drops fired too low are deposited early. Therefore, offset error correction can be calculated based on the differences. The error correction factors for each nozzle are then provided to the normal print job nozzle firing algorithm.

Other patterns and calculating algorithms can be developed for specific implementations. To cover the length and width of the print media, a printed circuit board detector is patterned to allow the firing of the full column height of the printhead and the signals processed in parallel.

It should be recognized that provision for cleaning the target at regular intervals needs to be incorporated into the hard copy apparatus. For example, the EDD array 400 can be protected by a glass thin film or a Kapton™ coating that would still allow the charge sensing to occur yet protect the silicon and the carriage can be provided with a wiper that is later cleaned at the commonly provided printhead service station.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art.

It should be recognized that the present invention can be implemented in both planar and curvilinear (spherical geometric planes) implementations.

It will also be recognized by those skilled in the art that a target device can be placed on both sides of the print media region of the print zone for bidirectional printing and used without substantial throughput delays.

Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. An ink-jet hard copy apparatus, having a printing zone and means for transporting print media to and through the printing zone, comprising:

at least one scanning printhead means for scanning across the printing zone, including scanning across the print media width and an additional predetermined region of the printing zone adjacent to the print media transported thereto, each of the printhead means having a plurality of individually selectable ink drop generators;

an ink drop detection target means for receiving individual ink drops fired from individually selected ink drop generators, the target means being mounted in the printing zone in the additional predetermined region and having a pattern of traces wherein spacing between the traces is greater than at least one dot formed by one of said ink drops received thereon;

associated with the target means, means for determining individual drop detector malfunctions and firing trajectory errors; and associated with the means for determining individual drop detector malfunctions and firing trajectory errors, means for providing signals indicative of the individual drop detector malfunctions and firing trajectory errors.

2. The apparatus as set forth in claim 1 comprising:

for bidirectional printing, mounting a plurality of targets on both sides of the maximum width of the print zone occupied by print media transported therethrough.

3. A method for detecting scanning ink-jet printhead drop firing characteristics, the method comprising:

determining a set of drop generators of the printhead to be used in a next printing scan from a predetermined set of data;

firing selected drop generators at a detector fixedly located within a printing zone of the printhead, the detector having a matrix of detecting elements sized substantially identically to pixels to be printed wherein the elements are arranged in a like plane and in like orientation as the pixels to be printed; and determining ink drop firing characteristics as a function of a correlation of the set of data to a second set of data produced by the detecting elements receiving drops of ink from the selected drop generators, wherein said determining includes determining drop volume of each drop deposited by each of the selected drop generators, respectively, and said determining drop volume includes determining all target elements upon which a drop has impacted, calculating the area of detector covered, and multiplying the area by a predetermined drop thickness constant.

* * * * *